United States Patent [19]

Ellis et al.

[11] 3,983,649

[45] Oct. 5, 1976

[54] REMINDER CARD RACK

[76] Inventors: Dale S. Ellis, DeMotte, Ind. 46310; Harriett Rex Smith, Rte. 7, Box 64, Ind. 46383

[22] Filed: May 19, 1975

[21] Appl. No.: 578,502

[52] U.S. Cl. ..... 40/122; 40/124.2; 211/55

[51] Int. Cl.[2] ..... G09D 03/06

[58] Field of Search ..... 40/122, 114, 124, 111, 40/107, 124.2, 124.4; 211/55, 50, 11

[56] References Cited

UNITED STATES PATENTS

| | | | |
|---|---|---|---|
| 384,526 | 6/1888 | Isbell | 40/122 X |
| 554,837 | 2/1896 | Seibert | 40/124.2 X |
| 1,455,192 | 5/1923 | Dumont | 40/124 X |
| 1,457,136 | 5/1923 | Auerbach | 40/124 X |
| 2,132,652 | 10/1938 | Schmiedemann | 40/122 X |
| 2,838,862 | 6/1958 | McConnell | 40/114 |

FOREIGN PATENTS OR APPLICATIONS

| | | | |
|---|---|---|---|
| 54,413 | 11/1890 | Germany | 40/122 |

*Primary Examiner*—John F. Pitrelli

[57] ABSTRACT

A reminder card or bill rack, or the like, which has a frame and a pair of side-by-side vertically aligned series of card pockets on the frame. Between the two series of pockets is a common vertical column of indicia on the frame dividing a given period of time, such as a month, into sub-increments, such as weeks, in alignment with the respective pockets. The frame has a housing at the top thereof within which is mounted a pair of roller members, one for each vertical series of pockets. Indicia is provided on each of the rollers, such as the twelve months of the year seriatim about the periphery of the rollers. A window is provided in the housing for each roller so as to observe the indicia thereon. Each roller is independently rotatable and has a handle connected thereto and exposed exteriorly of the housing for manual manipulation by a user. In this fashion, when a particular given period of time has been exhausted, such as the month on the lefthand column, cards need not be shifted thereto from the righthand column, but the roller for the lefthand column simply may be manipulated to skip a month so as to provide indicia in the window one month ahead of the month in the righthand column.

4 Claims, 5 Drawing Figures

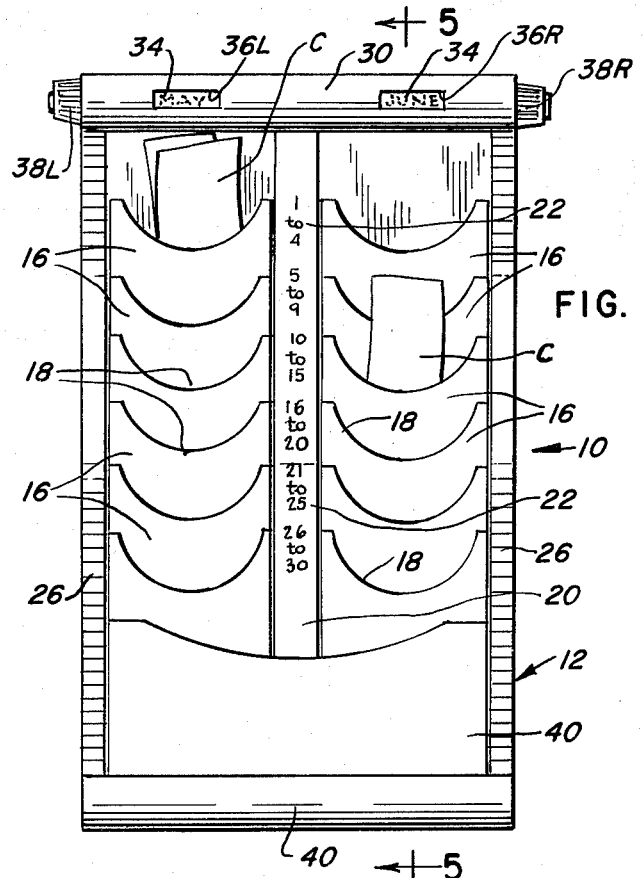
FIG. 3
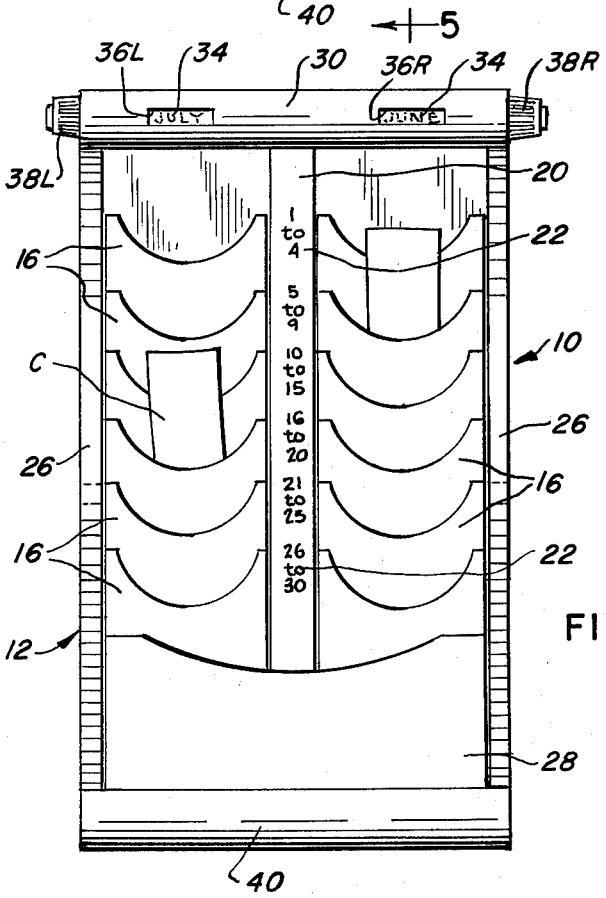
FIG. 4
FIG. 5
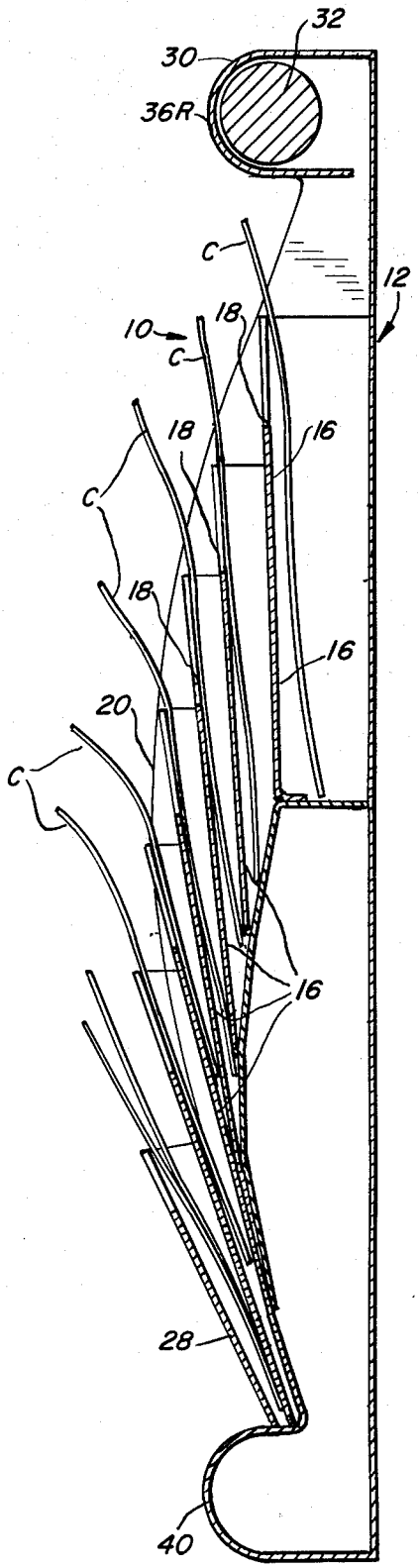

REMINDER CARD RACK

BACKGROUND AND SUMMARY OF THE INVENTION

This invention relates to a reminder card or bill rack of the character described. However, it is to be understood that the invention is not limited to cards or bills, but has wide utility for all ranges of items which must be serially stored and referred to periodically and in time order. In particular, the remainder card or bill rack, in essence, is continuously operable from one given period to a next without requiring the shifting of the cards or the like upon the expiration of one of the give periods of time.

More particularly, various card racks or the like have been available in which sales reminder cards, time sheets, bills due, and a wide range of numerous such articles which must be sorted in a convenient disposition for reference purposes, such as the payment of bills, particularly for continuous timely reference. However, in those instances where a plurality of given periods of time, such as a plurality of months, are utilized with such a device, at the expiration of one given period of time, such as the month of May, the device had to be readjusted for the month of June by adjusting the month and then shifting all of the cards into the readjusted series of card receiving receptacles. With the present invention, a reminder card or bill rack, or the like, is provided which is continuously operable over a plurality of given periods of time without incurring the necessity of shifting cards at the expiration of one of the periods of time.

Accordingly, it is an object of the present invention to provide a new and improved reminder card rack, or the like.

To this end, the reminder card or bill rack includes a frame, a first vertically aligned column of card receiving pockets on the frame, a second vertically aligned column of card receiving pockets on the frame in side-by-side relationship with the first column. Of course, the specific vertical disposition may be changed to other dispositions, such as horizontal, and the specific number of columns may be increased, all within the concepts of the present invention. Between the two columns of card receiving pockets is provided indicia on the frame "assigning" the respective pockets a sub-increment of time (such as a week or specific days of a month) of a specific given period of time (such as a month) for the entire column. A generally hollow housing is provided across the top of the frame within which is mounted a pair of rollers, one for each of the two columns of pockets. Each of the rollers is independently operable and has a plurality of given periods of time seriatim about the periphery thereof (such as the 12 months of the year). The housing is opaque and has a window for each roller so as to permit visual observation of only one of the months at a time. A manually manipulatable handle or knob is disposed exteriorly of the housing on the sides thereof, the knobs being connected to the rollers to facilitate independent manual rotation thereof. In this manner, cards may be placed in the lefthand column of pockets for one month of the year (such as May) and in the righthand column of pockets for a succeeding month of the year (such as April) and the cards can be referred to and removed progressively as time passes. At the end of April, for instance, all of the cards in the righthand column will have been exhausted and the roller for that column may be manually manipulated so as to skip a month and bring the indicia "June" into view in the window for the righthand column, since May is indicated in the lefthand column. Cards may be placed in the pockets for June, and so on throughout the year without having to shift cards from one series of pockets or receptacles to another.

Other objects, features and advantages of the invention will be apparent from the following detailed description taken in connection with the accompanying drawings.

BRIEF DESCRIPTION OF THE DRAWINGS

FIG. 3 is a front elevational view, on a reduced scale, of the card or bill reminder rack of FIG. 1;

FIG. 4 is a front elevational view similar to that of FIG. 3, but with the month indicia for the lefthand roller changed to skip the month indicated by the righthand roller; and FIG. 5 is a vertical sectional view, on an enlarged scale, taken generally along the line 5–4 of FIG. 3.

DETAILED DESCRIPTION OF THE INVENTION

Figure 1:
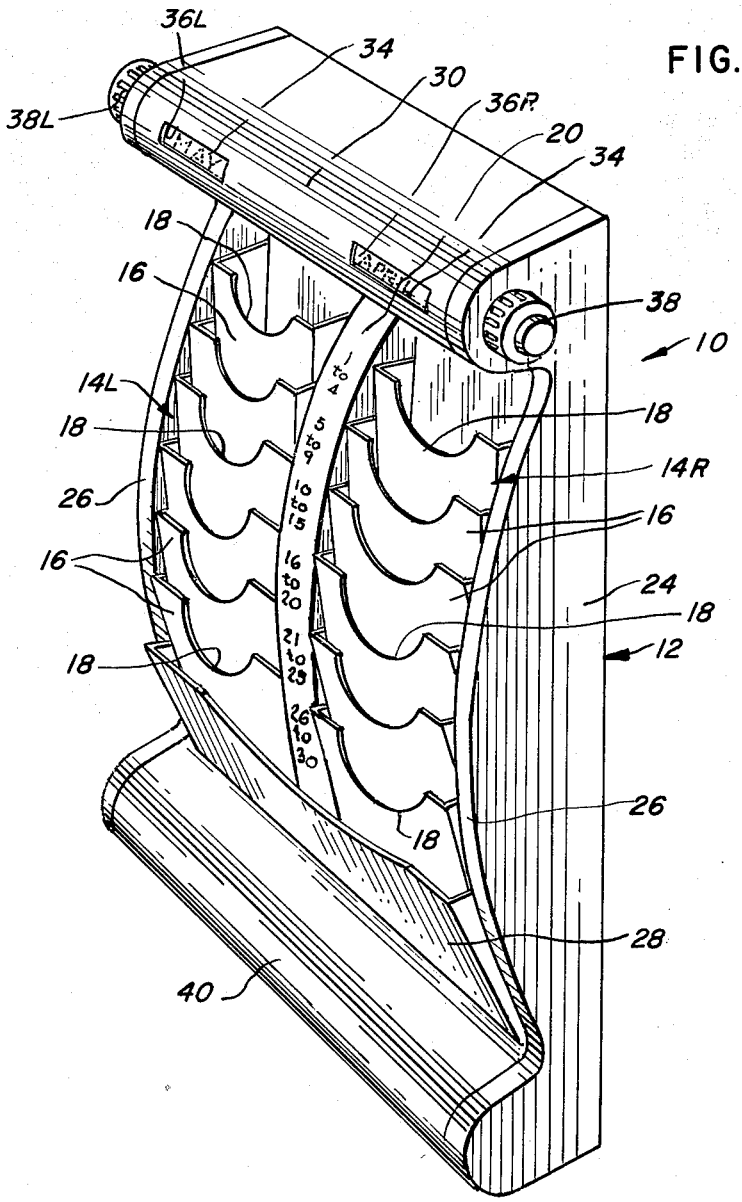
FIG. 1 is a front perspective view of an exemplary embodiment of a card or bill reminder rack in accordance with the concepts of the present invention.
Figure 2:
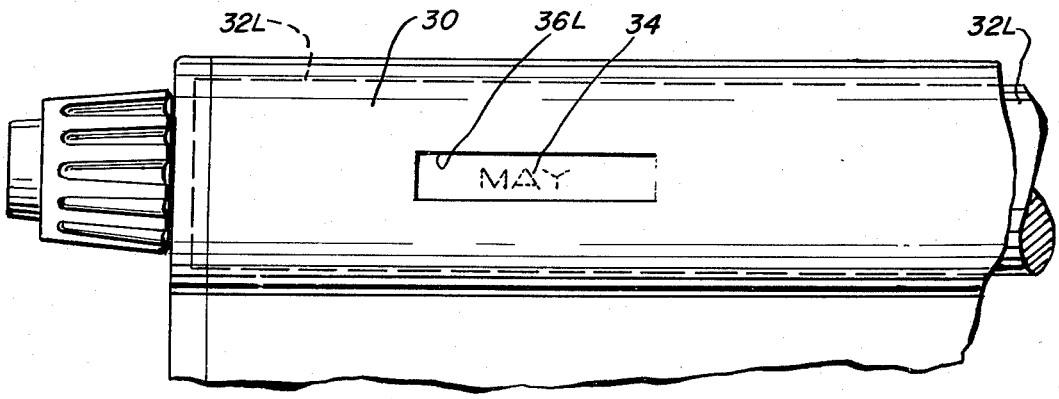
FIG. 2 is a fragmentary front elevational view, on an enlarged scale, showing the lefthand roller with indicia thereon (the month of May) observable through a window in the housing.

Referring to the drawings in greater detail, the card or bill reminder rack of the present invention, generally designated 10, includes a frame, generally designated 12, which has means on the front thereof defining a first and second vertical aligned series of card receptacles, generally designated 14L and 14R, for the lefthand and righthand series as viewed in FIGS. 1, 3 and 4. At this point, it should be pointed out that although only two series of card receptacles 14L and 14R are provided on the frame 12, any number of series of receptacles are contemplated by the present invention. In addition, the receptacles may be in other aligned dispositions, such as horizontal, in place of the vertical aligned disposition shown.

The left and righthand series of receptacles 14L and 14R are formed by a plurality of pockets 16 (six pockets being shown but any number being contemplated) having arcuate cutouts 18 along the top front edges thereof to facilitate grasping of cards disposed within the pockets. An arcuate or forwardly facing concave vertical rib 20 is formed by the frame 12 between the lefthand and righthand series of receptacles defined by the pockets 16. This rib 20 provides means whereupon indicia 22 is disposed for identifying the pockets 16 for given periods of time. With the embodiment of the invention shown herein, the indicia 22 between adjacent right and lefthand pockets represents either a week or a plurality of days of a month of the year.

In other words, as shown, the days of a month "1 to 4", "5 to 9," "10 to 15," etc. are provided on the rib 20 in alignment with respective adjacent pockets for instance to remind a person that the bills in those pockets are payable on the indicated days of the month. The indicia might be "first week," "second week," etc. of the month for adjacent pairs of pockets.

However, it must be pointed out that various sub-increments of time depending on the use of the device is contemplated by the present invention.

The frame 12 has side walls 24 which terminate forwardly in arcuate or forwardly concave ribs 26 similar in shape and depth perspective with the rib 20 to enhance the aesthetics of the device.

Below the lefthand and righthand pockets 16 is provided an elongated pocket 28 which extends substantially entirely across the front of the card reminder rack, is uninterrupted and provides a receptacle for various miscellaneous items.

The frame 12 has a generally hollow rounded housing 30 extending across the top thereof. This housing rotatably mounts therewithin a left and righthand roller 32L and 32R, respectively. The rollers 32L, and 32R are in vertical alignment with the lefthand and righthand series of card receptacles 14L, 14R and are independently rotatable relative to each other. Each roller 32L, and 32R has indicia 34 about the arcuate surface or periphery thereof to represent a plurality of given periods of time of which the indicia 22 comprise sub-increments. In the embodiment shown, the periods of time represented by the indicia 34 are the 12 months of a year, corresponding to the day or week sub-increments represented by the indicia 22 on the frame rib 20. Left and righthand windows 36L and 36R, respectively, are provided in the housing 30 of the frame 12 at the front thereof to permit visual observation of the indicia 34 on the rollers 32L, 32R. Left and righthand handles or knobs 38L and 38R, respectively, are connected to the rollers 32L and 32R, respectively, and are exposed exteriorly of the housing 30, on the sides thereof, to provide for manual manipulation of the respective rollers.

The frame 12 is provided with a lower rounded housing portion 40 similar to the upper housing 30 to provide general symmetry and enhanced aesthetics for the reminder card or bill rack.

Briefly, as pointed out more specifically in the Summary of the Invention herein, it is readily apparent that with the device of the present invention including a plural series of card receptacles 14L, 14R, the independently rotatable rollers 32L, 32R and the respective correlated indicia 22 and 34 on the frame and rollers, respectively, a completely continuous updated reminder card rack is provided without the necessity of having to shift cards or other items within the concept of the invention back and forth from one series of pockets or individual pockets to another at the expiration of specific periods of time. Referring to FIGS. 3 and 4, it can be seen that the lefthand column has been adjusted for the month of May and the righthand column has been adjusted for the month of June. At the expiration of the month of May, all of the cards C disposed therein either will have been exhausted or the date therefor having been past. A user of the device simply proceeds directly to the month of June as represented by the righthand column of card receiving pockets and the lefthand column can be readjusted to skip the month of June and proceed directly to the month of July without having to shift a single card because of the expiration of time (see FIG. 4).

The foregoing detailed description has been given for clearness of understanding only and no unnecessary limitations should be understood therefrom as some modifications will be obvious to those skilled in the art.

We claim:

1. A card or bill reminder rack, or the like comprising:

a frame;

a first aligned series of card receptacles on said frame;

a second aligned series of card receptacles on said frame in horizontal alignment with said first aligned series of card receptacles, each of said two series of card receptacles comprises a single verticle column of card pockets disposed in side-by-side relation on said frame;

indicia on said frame between said first and second series of card receptacles corresponding with said horizontal alignment said indicia on said frame is disposed between said side-by-side series of card pockets so as to provide common indicia for both series and comprises progressive sub-increments in the form of progressive weeks of the month; and an adjustable, independently operable date indicator means on said frame at one vertical end of each series of card receptacles, said date indicator means having means for selectively and progressively indicating months of the year for movement seriatim into visual registry one at a time.

2. The card or bill reminder rack of claim 1 wherein said date indicator for each series of card receptacles comprises a manually rotatable roller.

3. The card or bill reminder rack of claim 2 wherein said frame has means defining a housing for said rollers, means for independently rotatably mounting the rollers within said housing in horizontal alignment, a rotatable handle means connected to each roller and exposed exteriorly of the housing on respective opposite sides of the housing for manual manipulation, and a window in said housing for each of said rollers for visual observation of the periods of time on the rollers.

4. The card or bill reminder rack of claim 3 wherein said rollers are disposed at adjacent ends of said vertical columns and on an aligned horizontal rotatable axis.

* * * * *